United States Patent [19]

van Os

[11] 4,424,009

[45] Jan. 3, 1984

[54] PERISTALTIC PUMP

[75] Inventor: Cornelis J. van Os, Emmen, Netherlands

[73] Assignee: Noord-Nederlandsche Machinefabriek B.V., Winschoten, Netherlands

[21] Appl. No.: 167,354

[22] Filed: Jul. 10, 1980

[30] Foreign Application Priority Data

Jul. 12, 1979 [NL] Netherlands ..... 7905463

[51] Int. Cl.³ ..... F04B 43/10

[52] U.S. Cl. ..... 417/394; 417/474

[58] Field of Search ..... 417/394, 478, 474, 479

[56] References Cited

U.S. PATENT DOCUMENTS

| | | | |
|---|---|---|---|
| 2,786,419 | 3/1957 | Lynn | 417/474 X |
| 2,884,866 | 5/1959 | Patterson . | |
| 2,965,041 | 12/1960 | Clark . | |
| 3,105,447 | 10/1963 | Ruppert . | |
| 3,127,845 | 4/1964 | Voelcker | 417/478 |
| 3,332,746 | 7/1967 | Claff et al. | 417/395 |
| 3,359,916 | 12/1967 | Houston . | |
| 3,406,633 | 10/1968 | Schomburg | 417/394 |
| 3,429,272 | 2/1969 | Wilhite . | |
| 3,701,618 | 10/1972 | Wall et al. | 417/478 X |
| 3,814,547 | 6/1974 | Kitrilakis et al. | 417/478 X |
| 4,250,872 | 2/1981 | Tamari | 417/394 X |

FOREIGN PATENT DOCUMENTS

| | | |
|---|---|---|
| 1179115 | 10/1964 | Fed. Rep. of Germany . |
| 2342836 | 3/1975 | Fed. Rep. of Germany . |
| 2523059 | 12/1975 | Fed. Rep. of Germany . |
| 2430450 | 1/1976 | Fed. Rep. of Germany . |
| 836733 | 1/1939 | France . |
| 71299 | 11/1959 | France . |
| 940118 | 12/1948 | France . |
| 2168090 | 8/1973 | France . |
| 2175274 | 10/1973 | France . |
| 7700173 | 1/1977 | Netherlands . |
| 539203 | 8/1973 | Switzerland . |
| 769789 | 3/1957 | United Kingdom . |
| 916706 | 1/1963 | United Kingdom . |

*Primary Examiner*—Leonard E. Smith

*Attorney, Agent, or Firm*—Irvin A. Lavine

[57] ABSTRACT

A peristaltic pump comprising a pump housing wherein a hose is provided, leaving a hollow space surrounding the hose, while the ends of the hose are sealingly connected all around to the edge of a supply opening resp. discharge opening of the pump housing, and the pump housing being provided with means for supplying a medium to the hollow space, resp. discharging medium therefrom in order to exert pressure on the outer wall of the hose at desired points of time, whereby the hose adjacent the supply end for the material to be pumped is provided with a weakening.

35 Claims, 19 Drawing Figures

PERISTALTIC PUMP

The invention relates to a peristaltic pump comprising a pump housing wherein a hose is disposed, leaving a hollow space surrounding the hose, while the ends of the hose are connected all around sealingly to the edge of a supply opening, respectively discharge opening of the pump housing and whereby the pump housing is provided with means for supplying a medium to the hollow space, respectively discharging medium therefrom in order to exert pressure on the outer wall of the hose at desired points of time.

Such a peristaltic pump is known from U.S. Pat. No. 3,406,633. This prior art peristaltic pump is based on the principle that through supply of the medium to the hollow space, the hose may be compressed so that the pumpable material present in the hose is urged from the hose. In order to effect that the compression of the hose starts at the proper place, so that the pumpable material is forced in the proper direction, the wall thickness of the hose of the prior art peristaltic pump increases from the one end to the other end, or the modulus of elasticity of the hose material increases from the one end to the other end.

A drawback of this prior art peristaltic pump is that the required hose is difficult to manufacture. Another drawback is that the prior art peristaltic pump is not sucking in itself. Still another drawback is that in the prior art persitaltic pump a separate non-return valve is used which, if the pump is utilized for pumping blood, may result in damage to the blood platelets.

It is the object of the invention to remove the above drawbacks. To this effect according to the invention a peristaltic pump of the above-described type is characterized in that if a pressure is exerted on a hose all around, a local weakening of the hose wall may form a starting point for a directed disturbance of the equilibrium of forces acting around and in the hose wall.

In the pump according to the invention the weakening of the hose wall results in that during the exercise of pressure within the pump housing it is flattened adjacent said weakening and that the flattening movement is continued in longitudinal direction of the hose. By selecting the place of the weakening of the hose close to the one end of the hose fixedly connected to a wall of the pump housing, the locally occurring flattening movement will be further propagated along the hose in the direction of the other end thereof connected to a wall of the pump housing. With this flattening movement propagating along the hose, material may be forced through the hose from the weakening-containing portion of the hose in the direction of the opposite end of the hose then constituting the delivery side of the pump.

A pump according to the invention is suitable for transporting liquids or plastic masses of varying nature and composition, in particular for blood or blood plasma, dairy products, whether or not aggressive liquids or pastes for the food or chemical industry, and plastic raw material for the building industry. A hard particle present in the pumpable material will not damage the hose wall when being conducted through the hose: the flattened wall portions of the hose between which the particle is present will close bulgingly around the particle.

Some embodiments of the invention will now be described, by way of example, with reference to the accompanying drawings wherein FIG. 1 diagrammatically shows in longitudinal section an embodiment of a peristaltic pump according to the invention;

FIG. 2 diagrammatically shows in longitudinal section a modification of the pump according to FIG. 1 in a number of hose positions presented under a-f;

FIG. 3 diagrammatically shows in longitudinal section an embodiment of a pump according to the invention wherein adjacent the delivery end of the pump a second outer hose is disposed over a limited distance around the hose;

FIGS. 4–10 diagrammatically show alternative embodiments of the pump; and

FIG. 11 shows an embodiment of a combination of two pumps according to the invention.

FIG. 1 shows an embodiment of a peristaltic pump according to the invention. The pump indicated by 1 comprises a tubular housing 2 within which a hose 3 is disposed with reservation of a hollow space 4. The pump housing may be manufactured of metal but may also be of synthetic material. The material of the pump housing is so chosen that it is not or is slightly deformed at the pressures occurring in operation. The hose may be made of various materials conventional for hoses. The choice of material for the hose depends on the envisaged application of the pump. For pumping blood a hose of polyurethane is highly suitable. The ends of the hose are fixedly connected to the leading ends of the pump housing, which may be effected by glueing with collars 8 and 9, but also by suitably clamping the ends of the hose, if necessary after these ends have been bent over outwardly.

At relatively short distance from the righthand (in the drawing) end of the hose, it is provided with a weakening 5. Said weakening may be a single weakening which consists of a wall portion of the hose extending both longitudinally and circumferentially along a highly limited distance and that is weaker than the rest of the hose wall. The weakening may also comprise two radially oppositely disposed weakened wall portions (as shown) or a plurality of weakened wall portions regularly distributed along a circumferential line. The weakening might also consist of an annular weakened portion of the hose wall. The exact shape of the weakening is not highly important, as long as during the increase in pressure in the space 4 the hose starts to contract at the location of the weakening.

The weakening may be formed chemically as by locally modifying the composition of the hose wall during the manufacture of the hose or later on in a suitable manner.

It is also possible and perhaps even simpler to form the weakening by removing, with suitable tools in the place of the desired weakening, a part of the hose wall so that the hose wall becomes locally thinner.

If now a medium such as a gas or a liquid is supplied under pressure in the hose-surrounding space 4, via an opening 20 diagrammatically shown in FIG. 1, as a result of the pressure exerted on the hose wall, the hose will be compressed starting at the weakening, after which the flattening movement is continued in the direction of the other hose end, thereby forcing the pumpable material present in the hose in the direction of the flattening movement, as shown in FIG. 2.

FIG. 2 shows a plurality of successive stages that occur during the operation of the peristaltic pump.

FIG. 2 does not show the supply opening 20 but this is nevertheless present. Furthermore FIG. 2 shows to cams 6 which are disposed adjacent the weakening 5 which in FIG. 2 comprises two diametrically opposite weakened wall portions, on the inner wall of the pump housing. The cams 6 extend so far inwardly that the hose 3 is locally slightly impressed, thus effecting that the flattened hose always comes to lie in the median perpendicular plane, between the cams, as shown in FIGS. 2*d*–2*f*. This is of relevance for reasons to be discussed later on. Furthermore the cams may facilitate the initiation of the flattening movement. The shape of the weakening and the exact location thereof relative to the cams should be chosen in such a way that adjacent the indentations produced by the cams in the hose wall there are not produced such tensions in the hose wall that the flattening movement starts elsewhere in spite of the weakening.

It is observed that it is not strictly necessary to apply two oppositely disposed cams. It might be sufficient to use a single cam. It may be preferable in certain cases, inter alia depending on the shape of the weakening, to utilize a pair of juxtaposed cams extending longitudinally of the pump. Furthermore the cams, if desired, may extend each along a specific radial distance.

After reaching the flattened position of the hose 3, approximately as shown in FIG. 2*f*, the medium admitted into the hollow space 4 is removed, thus eliminating the pressure on the hose wall, while the elasticity of the hose wall ensures that the hose returns to the initial condition as shown in FIG. 2*a*, etc. The return to the initial condition may be enhanced by temporarily creating a vacuum in the space 4. In the embodiment of the pump shown in FIG. 3 (in FIG. 3*a* the same reference numerals relate to the same members or to members having the same function of the pump according to FIG. 2, while the reference numerals of FIG. 3*a* also apply to FIGS. 3*b*–3*d*) there is provided in the pump housing 2 internally a collar 10 at a short distance from the left hand or delivery end thereof. The collars 9 and 10 function as seats for adherence, e.g. by glueing or otherwise, thereon and all around of a second shorter hose 13, which is disposed about the first hose 3. At the collar 9 the inner surface of the outer hose 13 functions in turn as a support for fixedly connecting the end of the hose 3 thereon and all around by glueing or otherwise. The hollow space surrounding the first inner hose in the embodiment of the pump according to FIG. 2 is divided into two hollow spaces 12 and 11, whereby the space 11 corresponds in function to the space 4 according to FIG. 2.

The hose 13 need not be provided in principle with a weakening nor are cams, similar to the cams 6, necessary, since upon increasing pressure in the space 12 the hose 13 will always be flattened in the manner as shown in FIG. 3*b* and FIG. 3*c*. However, it is recommendable that the hose 13 in flattened condition is flush with the hose 3 in flattened condition in order to prevent both hoses from counteracting each other. In order to effect this, the hose 13 may be provided with a weakening in a manner similar to that described in respect of the hose 3 approximately one half of its length. Instead of a weakening also one or more cams may be provided similarly as the cams 6. Also a combination of weakening and one or more cams is possible.

The cam(s) and/or weakening associated with the short hose 13 should be positioned flush with the cam(s) and weakening associated with the hose 3.

The pump housing 2, as indicated in FIG. 1, is provided with a supply line shown in FIG. 3 for a pressure medium, which line terminates in the space 4. Furthermore the pump housing is provided with a supply line for a pressure medium terminating in the space 12 surrounding the short hose 13. This supply line is indicated by 21 in FIG. 3*a*.

By increasing the pressure in space 12, the short hose 13 may be brought in the position shown in FIG. 3*b* and 3*d*. Consequently, the short hose 13 may serve upon a suitable control as a sort of non-return valve which, however, contrary to conventional non-return valves, does not come into contact with the pumpable material and in the opened position does not hinder the throughflow in any way whatever. This offers the advantage that the inner wall of the pump hose 3, in spite of the presence of a non-return valve, may remain completely smooth, so that the pump can be cleaned simply and properly, which for instance in case of applications in the dairy industry and in particular with medical applications is of great importance. Furthermore particles possibly present in a pumpable liquid cannot be damaged by the non-return valve, which is of importance in particular when pumping blood, since the blood platelets may not be damaged.

The pump shown in FIG. 3 may be used as follows. If as the starting position there is chosen the position shown in FIG. 3*b*, wherein the pump hose 3 is released and filled with the pumpable material, while in the space 12 such a pressure prevails that the non-return valve is closed, subsequently the pressure in the space 11 is increased so that the pump hose 3 starts to contract. Approximately simultaneously the pressure in the space 12 is reduced, so that the non-return valve is opened. This situation is shown in FIG. 3*c*. If the pump hose 3 is flattened along the entire length, the pressure in the space 12 is again increased so that the non-return valve is closed. This condition is shown in FIG. 3*d*. Thereafter the pressure in the space 11 is again reduced so that the pump hose 3 may be released and is again filled with the pumpable material, so that the condition of FIG. 3*b* is reached again.

The pump according to FIG. 3 may also be fitted in such a way that the space 12 is filled once or upon operation with a gas at such a pressure that the hose 3 is kept normally closed but whereby, under pressure of the pumpable material advanced through the propagating flattening movement of the hose 3, the closure is eliminated and is immediately effected again as soon as the pressing movement is terminated. The pressure in the space 12 need then not be controlled separately.

Instead of a gas the space 12 may be provided with a liquid, while the volume displacement in said space during the pressing movement is enabled through the use of an accummulator 14 (FIG. 4) communicating with said space.

It is preferred that in case of inoperative installation and for the purpose of a careful cleaning or otherwise of the line system wherein the pump is incorporated, the medium in the two elastically deformable spaces 12 and 11 can be discharged in such a way that the throughflow channel is again optimally opened.

The pump housing is to be designed in such a way that through conventional connection methods, such as flange connections (15 in FIG. 5) the pump, seen linearly, forms an organic part of a line and, can be supported by same or may function as support of the line.

In certain cases, in particular when a rather slack hose 3 is applied, the sagging of the hose may produce such tensions in the hose wall that it is no longer ensured that the flattening movement starts at the weakening. This sagging may be prevented by filling the hollow space surrounding the pump hose with a liquid having a specific weight substantially corresponding with the specific weight of the pumpable material. The actuation of the pump then takes place by varying the quantity of liquid surrounding the hose.

Although proper results can be achieved also with a gas as pressure medium, the application of a liquid as the pressure medium enables a highly accurate control. The quantity of liquid supplied additionally to the space surrounding the pump hose, i.e. starting from the rest condition with a released pump hose, accurately determines as a matter of fact the quantity of material being pumped by each pumping stroke.

FIG. 5 diagrammatically shows in what manner a peristaltic pump according to the invention can be made of the self-suction type. The space surrounding the pump hose is filled with a liquid and is in communication via a line 16 with a closed vessel 17 wherein liquid is present. The line 16 terminates under the liquid level in the vessel 17. The vessel is positioned lower than the pump. In the vessel furthermore terminates a control line 18 which is connected to a control member 19 which again may be connected e.g. to a compressed air line. For effecting the pumping stroke the pressure above the liquid in the vessel 17 is increased via line 18 so that via line 16 liquid flows to the space surrounding the pump hose and so that the pump hose is squeezed.

After completing the pumping stroke the control member 19 reduces the pressure above the liquid in the vessel 17 to the starting value, e.g. to the atmospheric pressure. Thereby liquid flows back into the vessel 17 through the line 16. However as a result of the difference in level between the pump and the vessel 17, there is created thereby in the space surrounding the pump hose and consequently also in the pump hose itself, a vacuum which, since at that moment the non-return valve is closed, effects the self-suction effect.

By way of example use could be made of liquid glycerol (specific weight 1.2) and the vessel 17 could be positioned two meters lower than the pump.

If the maximum pumping stroke is utilized, the pump hose is completely flattened. Thereby the phenomenon may occur that the parts of the inner wall of the hose disposed against each other continue to adhere to each other, so that the pump hose is not opened quickly enough. This phenomenon is counteracted by applying a pump hose having a thicker wall or a pump hose of a material having a higher modulus of elasticity, so that the tensions accumulated in the hose wall during the flattening are sufficiently great for returning the pump hose at the required speed to the open condition. Naturally, a combination of the above-described features is possible.

A similar effect may be obtained by constructing the pump hose of two hoses, the one of which is disposed within the other. The inner hose should then have a slightly larger outer diameter than the inner diameter of the outer hose, and be applied under tension in the outer hose, whereby a given transverse contraction occurs. The additional energy required for compressing such an assembly of hoses promotes the quicker opening of the pump hose.

An other possibility to increase the opening of the pump hose from the compressed condition is to ensure that between the oppositely disposed parts of the inner wall of the hose there remain one or more gaps when the hose is in the flattened condition. Preferably said gaps should be positioned in such a way that the pump hose at the suction side is completely sealing in the flattened condition over a given distance.

This can be realized by applying on or in the inner wall of the pump hose, along a given length of the hose, a suitable profiling. Although such a solution is not inconvenient for specific applications, the cleaning of the pump hose is thus hampered. In particular with pumps for application in the dairy industry and in the medical field, this solution is therefore less suitable.

For these fields of application suitable solutions are shown in FIGS. 6–9.

In the embodiment shown in FIG. 6 of the pump according to the invention, at the inner side of the pump housing 2, two oppositely disposed ribs 60, 61 are disposed in longitudinal direction of the pump housing. When the pump hose 3 of which the starting position is indicated by a broken line, has been sufficiently flattened, the hose contacts on either sides the ribs 60, 61 so that there yet remains a narrow gap 63 within the flattened hose.

It is also possible to provide the pump hose itself with ribs 64, as shown in FIG. 7.

It is observed that the gap 63 in FIGS. 6–9 is drawn rather large for the sake of clarity. In practice said gap may be smaller.

In case the pump is used for pumping blood, the presence of a gap extending over a part of the length of the pump hose also reduces the chance of damage to blood platelets which in the absence of such a gap, might get clamped between the walls of the pump hose.

For similar reasons it is recommended upon application of a pump according to the invention for pumping blood, to also limit the contraction of the short hose 13 functioning as non-return valve. For this the same steps can be taken as shown in FIGS. 6–9 with respect to the pump hose itself. True, the non-return valve in such case is not entirely sealing, but if the gap is very narrow, only a slight backflow will occur during the release of the pump hose, which need not be a substantial drawback.

An other advantage of the maintenance of a gap when the pump hose if flattened, is that thereby the chance that gases or even particles are sucked from the material of the pump hose during the release of the hose and arrive in the pumpable material is minimized.

At the inner side thereof the hose 3 may be provided with and hence separated from the pumpable material by one or more elastic hoses serving as lining and having the same length or longer in view of the required particular material properties in respect of wear resistance, resistance to certain aggressive substances, or from hygienic considerations. In this case it is recommended that between the first hose 3 and the hose serving as lining there is applied a liquid or paste-like lubricant by which the mutual friction between the two walls during the elastic deformations may be minimized.

The application of a hose serving as a lining is especially recommendable for medical applications, since the pump itself need then not be completely sterile. As the lining hose may be simply used a normal infuse hose there which is inserted through the pump hose.

Figure 10:
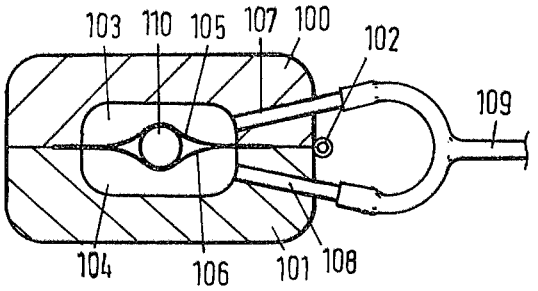

A different possibility is to construct the peristaltic pump of two halves pivoting relatively to each other, as shown in cross-section in FIG. 10. The housing of the pump shown in FIG. 10 comprises two halves 100 and 101 which at 102 are pivotally interconnected. In each half there is provided a chamber 103, 104. The chambers are oppositely disposed in the closed condition of the pump and at the sides facing towards each other are closed by members 105, 106. The chambers are furthermore each connected via a channel 107, 108 and communicating lines to a supply line 109 for the pressure medium.

Between the two membranes it is now possible to simply apply a hose 110 functioning as lining, e.g. an infuse hose, by opening the pump housing and closing same again after application of the lining hose and by locking same in a manner not further indicated. Obviously, in such an embodiment the non-return valve should be similarly built up of two halves.

Figure 9:
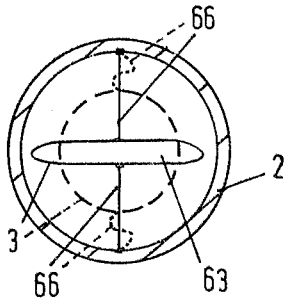
FIG. 9 shows a fourth alternative. Between the pump hose and the pump housing there are applied according to FIG. 9 connection elements 66 of e.g. textile or plastic, which during the flattening of the pump hose are tensioned and are completely tensioned the moment when inside the pump hose there is just present a free gap.

The pump may be provided in the same manner as in respect of the above-described embodiments, with weakenings in the membranes, cams and means for limiting the compression of the hose 110. For the latter purpose, the method indicated in FIG. 9 is the most suitable one.

The pump according to the invention can be properly protected against the occurrence of disturbances or the results therefrom. For instance, since the operation of the pump is substantially independent of the nature of the medium that is applied, it is possible for achieving the pressure fluctuations in the hollow space surrounding the hose 3, to select a medium the composition of which is adjusted to the chemical composition of the pumpable material in such a way that fire-prone reactions, explosion hazard, development or escape of substances detrimental to the health, the environment or apparatus are prevented or minimized if disturbances such as leakages might occur in the system.

In an other respect it is possible in the system controlling the supply and discharge of the medium to the hollow spaces surrounding the hose 3, to provide and adjust a signalling device through which, when attaining pre-determined pressures in the pump channel, the control of said system can be directly or indirectly influenced in the required sense.

Furthermore one or more provisions are to be applied in the wall of the hose 3 and/or 13 in such a way that signals for controlling or monitoring purposes can be transmitted thereby. The respective means may be based on change in inductance, capacitance or resistance of electric currents or on changes in resistance of liquids or gases which flow through channels specially disposed on or in the wall. A useable aid in this respect are strain gauges.

The output of the pump according to the invention per pressing movement, i.e. the movement of the hose wall as represented successively by FIGS. *2a–2f*, may be controlled in a stepless manner by controlling the quantity of the supplied pressure medium per pressing movement accordingly, while the speed at which the pumpable material is displaced can be controlled in a stepless manner by controlling accordingly the speed at which the medium is supplied.

The material from which the elastic hose contacting the pumpable material is to be made can be chosen in respect to the structure in such a way that through osmosis an exchange of substances takes place between the pressure medium to be supplied to the space surrounding the elastic hose and the material to be forced through the hose, so that the pump may be considered for use in an artificial kidney system.

Figure 1:
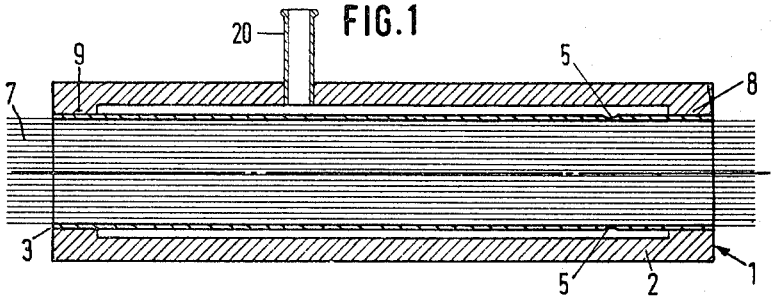
Figure 3:
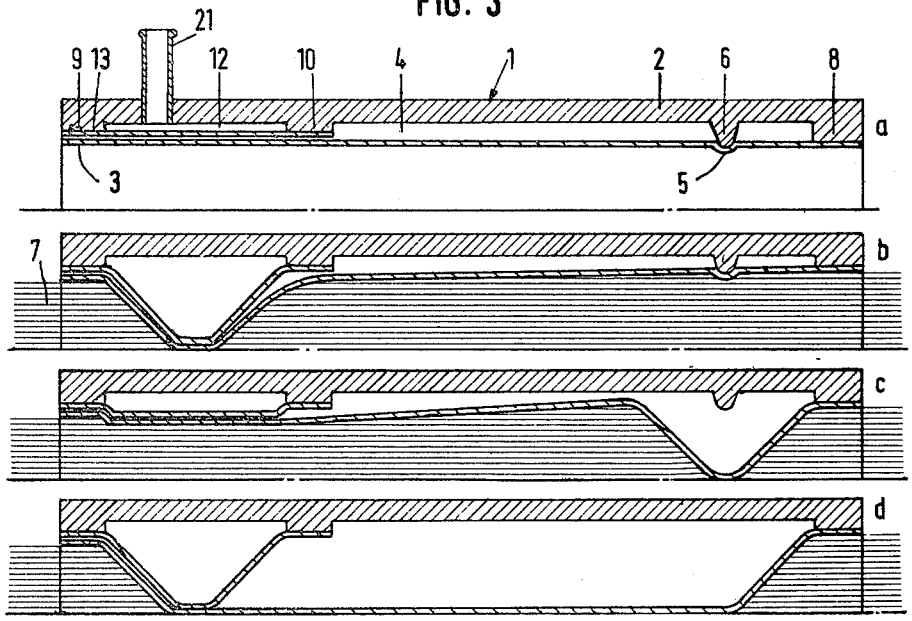
Figure 2:
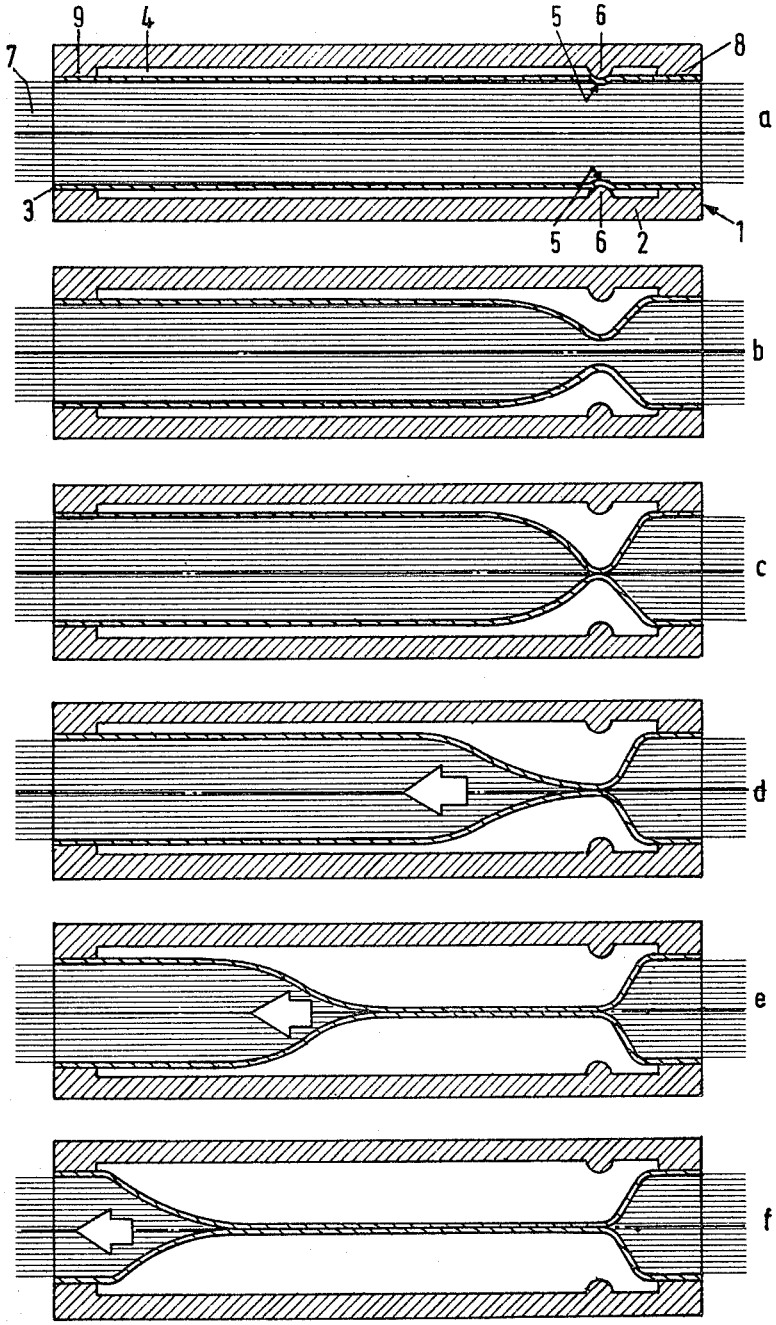
Figure 4:
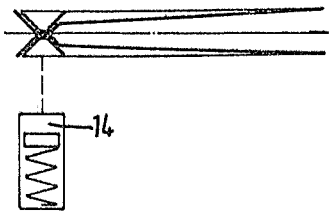
Figure 5:
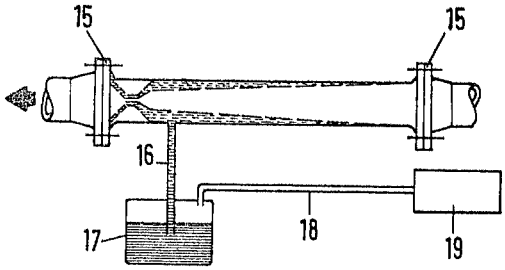
Figure 11:
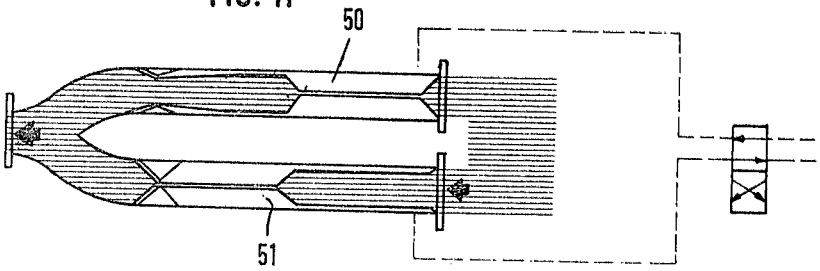
Figure 6:
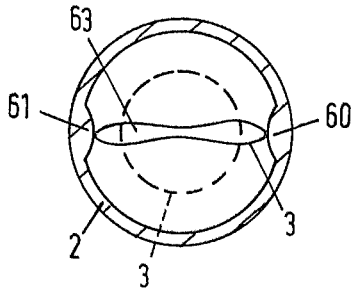
Figure 7:
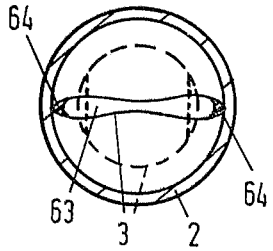
Figure 8:
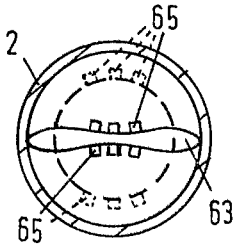
FIG. 8 shows a third possibility consisting in applying on the outer wall of the hose adjacently disposed projections 65, which may also have the shape of parallel ribs, and which if the pump hose has been flattened to a certain degree, contact against each other and prevent the pump hose from being further flattened.

A number of the pumps according to the invention can be used in combination. FIG. 11 diagramatically shows a system that comprises two independently arranged pumps 50 and 51, incorporated in a circuit arrangement controlling the pressing movements of the pumps in such a way that signals shifted in phase through 180° relatively to each other are applied to the pumps 50, 51 for introducing and eliminating the pressing movements of the elastic hoses. As a result it is possible on the one end to obtain with pumps connected in parallel a non-pulsating or at least not strongly pulsating flow of material or in case of pump bodies connected in series, to increase the manometric head without resulting in an increased load of the hose wall.

The operation of the pump according to the invention substantially is independent of the dimension thereof. In the direction of a reduction of the dimensions, the pump may be so designed that the elastic hose at the two ends thereof passes into a tube having an outer diameter that is adjusted to the interior dimensions of the ends of a cut artery in order to improve the blood flow in a human or animal body or to maintain same.

Material composition differences that may lead to the weakening of the elastic hose required for the proper compression may be those whereby the hose is made of an electrically poorly conducting material having a partly or completely metallized surface, while then instead of a gaseous or liquid medium use is made of electromagnetic fields operative around or in close proximity to the elastic hose. If desired, the hose may be made of a metal type atuned to the utilization purpose.

The medium producing pressure variations in the space surrounding the elastic hose through volume variations may also be chosen in respect of the property that through change of the temperature of the medium it is subjected to a change in volume.

Naturally, modifications may be applied in the embodiments shown in the drawing and described in the above without departing of the scope of the invention.

I claim:

1. A peristaltic pump comprising:

(a) a hollow linear pump housing having opposite ends, (b) a hose extending linearly in said housing and spaced therefrom along its length, leaving a hollow space surrounding the hose, said housing having a supply opening in one end and a discharge opening in the other end, (c) the ends of the hose being sealingly connected all around to the edge of the supply opening and the discharge opening of the pump housing, respectively, (d) the pump housing provided with means for supplying a fluid medium to the hollow space, and for discharging medium therefrom, in order to exert pressure on the outer wall of the hose at desired times to collapse the hose inwardly upon the introduction of fluid medium into the hollow space, (e) characterized in that the hose has uniform wall thickness and elasticity throughout its length except that adjacent the supply end for the material to be pumped the hose is provided with a weakening.

2. A peristaltic pump according to claim 1, characterized in that substantially adjacent the weakening there is provided on the inner wall of the pump housing at least one cam which in the rest position slightly compresses the hose wall.

3. A peristaltic pump according to claim 1, characterized by two cams on the inner wall of the pump housing, disposed radially opposite to each other substantially adjacent the weakened hose wall portions, which cams slightly compress the hose wall locally.

4. A peristaltic pump according to claim 1, characterized in that the gas or liquid to be applied in the first and second hollow space is not chemically reactive or innocuously reactive in regard of the material to be pumped.

5. A peristaltic pump according to any one of claim 1, characterized in that means are provided which obstruct a complete compression of the hose.

6. A peristaltic pump according to claim 5, characterized in that the last mentioned means comprise projections disposed on either side of the hose on the inner wall of the pump housing.

7. A peristaltic pump according to claim 5, characterized in that the last mentioned means comprise diametrically opposite projections or thickenings of the hose wall.

8. A peristaltic pump according to claim 5, characterized in that the last mentioned means comprise a plurality of interspaced, adjacently disposed projections or thickenings of the hose wall which upon compression of the hose come to lie against each other and within the hose there is a gap-like free space present and which obstruct a further compression of the hose.

9. A peristaltic pump according to claim 5, characterized in that the last mentioned means comprise tensioning means which are connected to the hose and to the pump housing and which are completely tensioned when within the hose there is still a gap-like free space present.

10. A peristaltic pump according to claim 1, characterized in that the wall of the hose is brought under a radial pre-compression.

11. A peristaltic pump according to claim 10, characterized in that the radial pre-compression is obtained by applying within the said hose a second hose longitudinally stressed in tension and having in released condition a slightly larger outer diameter than the inner diameter of the first hose, after which the tension is removed.

12. A peristaltic pump according to claims 10 or 11 claims, characterized in that the first hose comprises on the inside a removable elastic hose serving as lining for the interior wall surface thereof.

13. A peristaltic pump according to claim 12, characterized in that between the first hose and the hose serving as lining there is provided a liquid or paste-like lubricant.

14. A peristaltic pump according to claim 11, characterized in that on and/or in the wall of the first and/or second elastic hose there are provided one or more signal-producing means suitable for controlling or monitoring purposes.

15. A peristaltic pump according to claim 1, characterized in that the weakening is formed by locally changing the chemical composition of the wall.

16. A peristaltic pump according to claim 1, characterized in that the weakening comprises a locally thinned portion of the hose wall.

17. A peristaltic pump according to claim 15 or 16, characterized in that the weakening comprises two diametrically opposite weakened hose wall portions extending along a relatively slight radial and longitudinal distance.

18. A peristaltic pump according to claim 15 or 16, characterized in that the weakening comprises an annularly weakened hose wall portion.

19. A peristaltic pump according to claim 16, characterized by means which effect that the first hose upon increase of the pressure in the hollow space surrounding said hose is compressed in such a way that within the hose there remains a gap-like space starting at some distance from the weakening and extending in the direction of the discharge opening.

20. A peristaltic pump according to claim 19, characterized in that the last mentioned means comprise projections disposed on either side of the hose on the inner wall of the pump housing.

21. A peristaltic pump according to claim 19, characterized in that the last mentioned means comprise diametrically opposite projections or thickenings of the hose wall.

22. A peristaltic pump according to claim 19, characterized in that the last mentioned means comprise a plurality of interspaced, adjacently disposed projections or thickenings of the hose wall, which upon compression of the hose come to lie against each other when within the hose there is still a gap-like free space present and which counteract a further compression of the hose.

23. A peristaltic pump according to claim 19, characterized in that the last mentioned means comprise tensioning means which are connected to the hose and to the pump housing and which are completely tensioned when there is still a gap-like free space present within the hose.

24. A peristaltic pump according to claim 1, characterized by a second, relatively short hose provided adjacent the discharge opening in the pump housing, which hose lies around the first hose and which is surrounded by a second hollow space separated from the first and to which a pressure medium can be supplied.

25. A peristaltic pump according to claim 24, characterized in that the pressure medium is disposed once in the second hollow space under a suitably chosen pre-compression.

26. A peristaltic pump according to claim 24, characterized in that the second hollow space is provided with a liquid and communicates with a pressure accumulator.

27. A peristaltic pump according to claim 24, characterized by control means which supply alternately pressure medium to the first, and second hollow space in order to alternately compress the first hose, and the second outer hose.

28. A peristaltic pump according to any one of claims 24, 25, 26 or 27, characterized in that the outer hose approximately half-way its length is provided with one or more weakened wall portions in registry with the weakened wall portion or the weakened wall portions of the first or inner hose.

29. A peristaltic pump according to claim 28, characterized by one or more cams disposed adjacent the weakened wall portions of the outer hose on the inner wall of the pump housing, which cams slightly compress the hose wall locally.

30. A peristaltic pump according to any one of claims 24, 25, 26 or 27, characterized by at least one cam disposed on the inner wall of the pump housing substantially half-way the length of the outer hose, which cam slightly compresses the hose wall locally.

31. A peristaltic pump according to claim 30, characterized by a pair of cams disposed radially opposite to each other on the inner wall of the pump housing substantially half-way the length of the outer hose, which cams slightly compress the hose wall locally and which are in registry with the cams and/or weakening of the inner hose.

32. A peristaltic pump according to claims 1 or 11, characterized in that the material from which the first hose is made permits osmosis between the material to be pumped and the gas or liquid to be applied as pressure medium in the hollow space surrounding the first hose.

33. A peristaltic pump according to claims 1 or 24, characterized in that the housing comprises two halves pivoting relative to each other in each of which there is recessed a chamber which together constitute the hollow space(s) surrounding the hose or hoses and to which pressure medium may be supplied, while the hose or hoses is or are formed by membranes shutting off the chambers, which membranes in the closed condition of the housing are oppositely disposed and wherebetween in opened condition of the housing an additional hose through which the pumpable material can be conducted, may be installed, whereby the housing is provided with means for locking same in the closed condition.

34. A peristaltic pump according to claims 1 or 24, characterized in that the first hollow space is filled with liquid and communicating via a line with a closed vessel in lower position which is likewise filled with liquid to a given level in such a way that the end of the line extends to underneath the liquid level in the vessel, while above the liquid level in the vessel terminates a control line connected to a pressure control means.

35. A peristaltic pump according to claim 34, characterized in that as liquid is used glycerol.

* * * * *